United States Patent [19]

Allen et al.

[11] Patent Number: 4,987,630

[45] Date of Patent: Jan. 29, 1991

[54] DESTATICIZING AND CLEANING APPARATUS

[75] Inventors: Phillip G. Allen, Merseyside; Gordon J. Rigby, Nr. Wigan, both of England

[73] Assignee: Delco Electronics Overseas Corporation, Detroit, Mich.

[21] Appl. No.: 463,688

[22] Filed: Jan. 11, 1990

[30] Foreign Application Priority Data

Jan. 17, 1989 [GB] United Kingdom ..... 8900951.8

[51] Int. Cl.[5] ..... A47L 5/38

[52] U.S. Cl. ..... 15/1.51; 15/306.1; 15/309.2; 15/345

[58] Field of Search ..... 15/1.51, 306.1, 309.1, 15/309.2, 346, 308, 345

[56] References Cited

U.S. PATENT DOCUMENTS

| | | | |
|---|---|---|---|
| 3,078,496 | 2/1963 | Doran et al. | 15/346 |
| 3,239,863 | 3/1966 | Gardner | 15/345 X |
| 4,026,701 | 5/1977 | Till et al. | 15/345 X |
| 4,454,621 | 6/1984 | Testone | 15/307 X |
| 4,727,614 | 3/1988 | Swistun | 15/345 X |
| 4,835,808 | 6/1989 | Hahne et al. | 15/1.51 |
| 4,854,441 | 8/1989 | McBrady et al. | 15/308 X |
| 4,883,542 | 11/1989 | Voneiff | 15/308 X |

*Primary Examiner*—Chris K. Moore

*Attorney, Agent, or Firm*—Mark A. Navarre

[57] ABSTRACT

Apparatus is disclosed for destaticizing and cleaning partially assembled items being transported on a continuously movable line, the apparatus comprises a housing which substantially surrounds the continuously movable line, static reduction apparatus which provides a static reduction zone within the housing, air input apparatus which provides air input into the housing, an air curtain through which the continuously movable line passes, and air exhaust apparatus which exhausts air from within the housing. The volumetric input of air provided by the air input apparatus is substantially equal to the volumetric output of air exhausted by the air exhaust apparatus so that substantially no movement of air occurs at the entrance to and exit from the housing. The air input apparatus removes substantially all dust and/or other foreign particles from the partially assembled items and holds them in suspension in the circulating air before being exhausted.

8 Claims, 1 Drawing Sheet

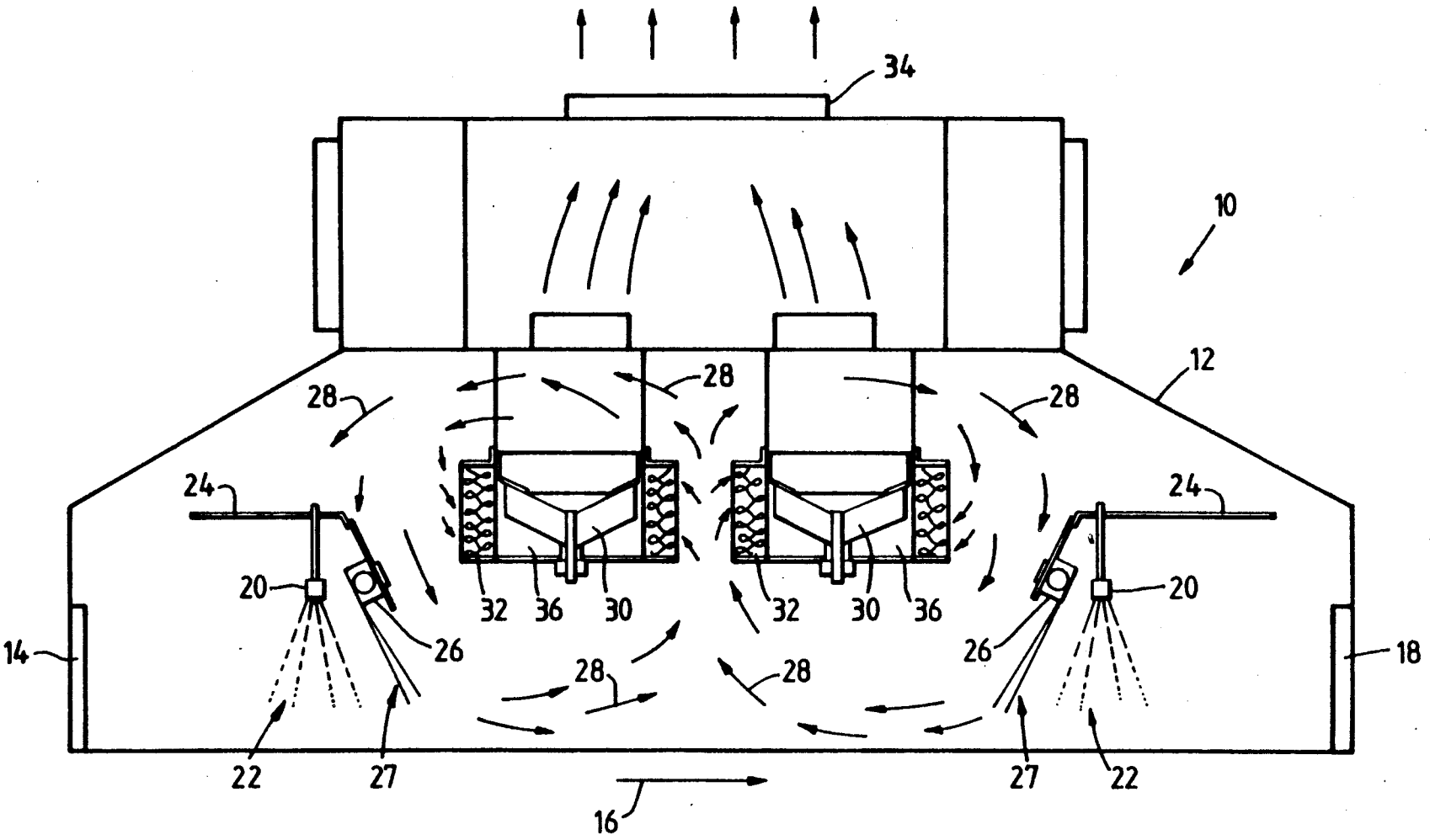
10
12
14
16
18
20
22
24
26
27
28
30
32
34
36

DESTATICIZING AND CLEANING APPARATUS

This invention relates to apparatus for destaticizing and cleaning partially assembled items prior to final assembly. The apparatus has particular application on a continuous production line where the partially assembled items are being transported from one subassembly station to another subassembly station by way of a conveyor belt or other continuously movable line. The apparatus is dynamic in the sense that overall dimensions can be adapted to suit various applications.

It has been found that static electricity and dust or other foreign particles can seriously affect the accuracy of reading from an instrument or instruments of an instrument cluster of a motor vehicle. In addition, contamination detracts from the overall visual quality of the product, which is unacceptable to the customer.

It is an object of the present invention to overcome the above mentioned problem by providing apparatus which substantially reduces static charge, and which removes substantially all dust or other foreign particles from an instrument cluster prior to final assembly.

Apparatus for destaticizing and cleaning partially assembled items in accordance with the present invention comprises a housing which substantially surrounds a continuously movable line on which the partially assembled items are transportable, the housing having an entrance and an exit for the continuously movable line; static reduction means which provides a static reduction zone positioned within the housing through which the continuously movable line passes; air input means which provides air input into the housing, air circulation within the housing, and an air curtain through which the continuously movable line passes; and air exhaust means which exhausts air from within the housing; the volumetric input of air provided by the air input means being substantially equal to the volumetric output of air exhausted by the air exhaust means such that substantially no movement of air occurs at the entrance to and exit from the housing.

Static charge on the partially assembled items is reduced in the static reduction zone. The air curtain removes substantially all dust and/or other foreign particles from the partially assembled items, and the removed particles are held in suspension in the air circulating in the housing, before being removed by the air exhaust means.

Preferably, the air input means comprises a pressure regulator, a filter, a solenoid operated valve, and an air curtain unit. In this case, the air input means preferably comprises two air curtain units which are spaced apart and positioned to provide air curtains having converging air flows through which the continuously movable line can pass. Further, in this case, the apparatus preferably comprises two static reduction zones which are spaced apart and through which the continuously movable line can pass, the arrangement being, in order upstream from the entrance to the housing, the first static reduction zone, the first air curtain unit, the second air curtain unit, and the second static reduction zone. The filter removes oil and/or any other foreign particles from the air before it enters the housing. The solenoid operated valve prevents air entering the housing when the apparatus is not operating.

The static reduction means preferably comprises a step-up transformer connected to a static elimination bar having an operating voltage of up to 7000 volts. In this case, the static reduction means preferably comprises two static elimination bars which are spaced apart to provide two static reduction zones through which the continuously movable line can pass. The static reduction zone or zones preferably reduce the static charge on the partially assembled items by in excess of 50%.

Preferably, the air exhaust means comprises a fan having an adjustable speed, and an air filter which removes particles suspended in the air circulating in the housing. In this case, a neutral plenum is preferably set up on the exhaust side of the air filter to substantially prevent unfiltered air being exhausted by the air exhaust means. Further, the air exhaust means preferably comprises an air differential pressure monitor positioned downstream of the air filter which monitors any changes in air pressure to provide an indication that the air filter is becoming blocked and needs replacing.

BRIEF DESCRIPTION OF THE DRAWING

The present invention will now be described, by way of example, with reference to the accompanying drawing which is a cross-sectional schematic view of apparatus in accordance with the present invention.

Referring to the drawing, the apparatus 10 comprises a housing 12 which substantially surrounds a continuously movable line in the form of a conveyor belt (not shown). The conveyor belt enters the housing through entrance 14 and moves through the housing in the direction indicated by arrow 16 before leaving through exit 18. Instrument clusters (not shown) prior to final assembly, which define partially assembled items, are transported through the housing 12 on the conveyor belt.

The apparatus 10 also comprises static reduction means which comprises a step-up transformer (not shown) and two static elimination bars 20 positioned within the housing 12. The step-up transformer provides an operating voltage at the static elimination bars 20 of up to 7000 volts. The static elimination bars 20 therefore provide two static reduction zones 22 which are spaced apart and through which the instrument clusters pass. A reduction of static charge in excess of 50% has been achieved with this arrangement.

Air input means of the apparatus 10 is provided by a pressure regulator (not shown), a microfine oil filter (not shown), and a solenoid operated valve (not shown) which are connected in an air line 24 downstream of two air curtain units 26 positioned inside the housing 12. The solenoid operated valve blocks off the air supply to the apparatus 10 when the apparatus is not in use. The microfine oil filter removes oil and any other dust or foreign particles from the air prior to it entering the housing 12. The air curtain units 26 are spaced apart in such a manner as to provide air curtains 27 having converging air flows through which the instrument clusters pass, and also provide air movement (as indicated by arrows 28) within the housing 12. The flow of air from the air curtain units 26 blows dust or other foreign particles off the instrument clusters and holds it in suspension in the circulating air.

The apparatus 10 further includes air exhaust means which comprises two fans 30, each with there own air filter 32. The fans 30 draw air (which contains the suspended particles of dust or other foreign particles) from the housing 12 through the air filters 32 (which filters out the suspended particle), and then pushes the filtered air out though an exhaust outlet 34. The speed of the fans 30 is adjustable, and is set such that the volumetric input of air from the air curtain units 26 is substantially equal to the volumetric output of air from the fans 30. This ensures that substantially no movement of air occurs at the entrance 14 and exit 18 to the housing 12. Further, a neutral plenum 36 is set up on the exhaust side of each air filter 32 which substantially ensures no unfiltered air passes through the exhaust outlet 34.

An air differential pressure transducer (not shown) is positioned on the exhaust side of the air filters 32 which monitors the air pressure in the air exhaust means. Any drop in pressure, due to blocking of the air filters 32, is monitored by the air differential pressure transducer which triggers a warning device (not shown), indicating that the air filters 32 need changing.

The above described apparatus 10 provides destaticizing and cleaning of instrument clusters (or other partially assembled items) by substantially removing all dust and/or other foreign particles, and by reducing static charge by in excess of 50%. The apparatus 10 can be set up to run on an automatic basis, and can be monitored and controlled by a computerized control unit. Further, a combination achieved by setting air curtain 27 and fan 30 speed ensures that the apparatus 10 performs in an acceptable manner to the operators in close proximity. That is, no drafts are exhausted, and minimal noise is generated.

The embodiments of the invention in which an exclusive property or privilege is claimed are defined as follows:

1. Apparatus for destaticizing and cleaning partially assembled items being transported on a continuously movable line, the apparatus comprising a housing which substantially surrounds the continuously movable line, the housing having an entrance and an exit for the continuously movable line; static reduction means which provides a static reduction zone positioned within the housing through which the continuously movable line passes; air input means which provides air input into the housing, air circulation within the housing, and an air curtain through which the continuously movable line passes; and air exhaust means which exhausts air from within the housing; the volumetric input of air provided by the air input means being substantially equal to the volumetric output of air exhausted by the air exhaust means such that substantially no movement of air occurs at the entrance to and exit from the housing.

2. Apparatus as claimed in claim 1, wherein the air input means comprises a pressure regulator, a filter, a solenoid operated valve, and an air curtain unit.

3. Apparatus as claimed in claim 2 comprising two air curtain units which are spaced apart and positioned to provide air curtains having converging air flows.

4. Apparatus as claimed in claim 3 comprising two static reduction zones which are spaced apart, the arrangement being, in order upstream from the entrance to the housing, the first static reduction zone, the first air curtain unit, the second air curtain unit, and the second static reduction zone.

5. Apparatus as claimed in claim 1, wherein the static reduction means comprises a step-up transformer connected to a static elimination bar having an operating voltage of up to 7000 volts.

6. Apparatus as claimed in claim 5 comprising two static elimination bars which are spaced apart to provide two static reduction zones.

7. Apparatus as claimed in claim 1, wherein the air exhaust means comprises a fan having an adjustable speed, and an air filter.

8. Apparatus as claimed in claim 7, wherein the air exhaust means further comprises an air differential pressure monitor.

* * * * *